US009003804B2

(12) United States Patent
Prociw

(10) Patent No.: US 9,003,804 B2
(45) Date of Patent: Apr. 14, 2015

(54) MULTIPOINT INJECTORS WITH AUXILIARY STAGE

(71) Applicant: Lev Alexander Prociw, Johnston, IA (US)

(72) Inventor: Lev Alexander Prociw, Johnston, IA (US)

(73) Assignee: Delavan Inc, West Des Moines, IA (US)

( * ) Notice: Subject to any disclaimer, the term of this patent is extended or adjusted under 35 U.S.C. 154(b) by 193 days.

(21) Appl. No.: 13/647,867

(22) Filed: Oct. 9, 2012

(65) Prior Publication Data

US 2013/0036741 A1 Feb. 14, 2013

Related U.S. Application Data

(63) Continuation-in-part of application No. 12/954,008, filed on Nov. 24, 2010.

(51) Int. Cl.

| | |
|---|---|
| ***F02C 1/00*** | (2006.01) |
| ***F23R 3/34*** | (2006.01) |
| ***F23R 3/36*** | (2006.01) |

(Continued)

(52) U.S. Cl.

CPC . *F23R 3/346* (2013.01); *F23R 3/36* (2013.01); *F23R 3/44* (2013.01); *F23R 3/54* (2013.01); *F23D 17/002* (2013.01);

(Continued)

(58) Field of Classification Search

CPC ..... F23R 3/06; F23R 3/46; F02C 7/222; F02C 7/28

USPC ..... 60/742, 747, 746, 740

See application file for complete search history.

(56) References Cited

U.S. PATENT DOCUMENTS

| | | | |
|---|---|---|---|
| 2,607,193 | A | 8/1952 | Berggren et al. |
| 3,680,793 | A | 8/1972 | Tate et al. |

(Continued)

FOREIGN PATENT DOCUMENTS

| | | | |
|---|---|---|---|
| EP | 0509496 | A1 | 10/1992 |
| EP | 1398570 | A2 | 3/2004 |

(Continued)

OTHER PUBLICATIONS

R. Tacina et al. "Experimental Investigation of a Multiplex Fuel Injector Module With Discrete Jet Swirlers for Low Emission Combustors," NASA/TM-2004-212918; AIAA-2004-0185 (2004).

(Continued)

*Primary Examiner* — Phutthiwat Wongwian
*Assistant Examiner* — Alain Chau
(74) *Attorney, Agent, or Firm* — Locke Lord LLP; Scott D. Wofsy; Joshua L. Jones

(57) ABSTRACT

A multipoint combustion system for a gas turbine engine includes a housing defining a pressure vessel. A master injector is mounted to the housing for injecting fuel along a central axis. A plurality of slave injectors are each disposed outward of the master injector for injecting fuel and air in an ignition plume radially outward of fuel injected through the master injector. The master injector and slave injectors are configured and adapted so the injection plume of the master injector intersects with the ignition plumes of the slave injectors. A primary manifold is included within the pressure vessel for distributing fuel to the slave injectors. An auxiliary manifold is in fluid communication with the auxiliary nozzles of the slave injectors for issuing an auxiliary flow of fuel from the auxiliary nozzles that is separate from the fuel flow of the primary manifold.

14 Claims, 2 Drawing Sheets

(51) Int. Cl.
*F23R 3/44* (2006.01)
*F23R 3/54* (2006.01)
*F23D 17/00* (2006.01)

(52) U.S. Cl.
CPC ..... *F23C 2201/20* (2013.01); *F23N 2027/06* (2013.01); *F23R 2900/00002* (2013.01)

(56) References Cited

U.S. PATENT DOCUMENTS

| | | | | |
|---|---|---|---|---|
| 4,100,733 | A | 7/1978 | Striebel et al. | |
| 4,598,553 | A | 7/1986 | Saito et al. | |
| 5,235,814 | A * | 8/1993 | Leonard | 60/738 |
| 5,359,847 | A * | 11/1994 | Pillsbury et al. | 60/39.463 |
| 5,409,169 | A | 4/1995 | Saikalis et al. | |
| 5,713,206 | A | 2/1998 | McWhirter et al. | |
| 5,983,642 | A * | 11/1999 | Parker et al. | 60/737 |
| 6,092,363 | A | 7/2000 | Ryan | |
| 6,360,525 | B1 | 3/2002 | Senior et al. | |
| 6,363,726 | B1 | 4/2002 | Durbin et al. | |
| 6,533,954 | B2 | 3/2003 | Mansour et al. | |
| 6,622,488 | B2 | 9/2003 | Mansour et al. | |
| 6,688,534 | B2 | 2/2004 | Bretz | |
| 6,755,024 | B1 * | 6/2004 | Mao et al. | 60/776 |
| 6,772,583 | B2 | 8/2004 | Bland | |
| 6,854,670 | B2 | 2/2005 | Sumisha et al. | |
| 6,862,888 | B2 * | 3/2005 | Akagi et al. | 60/740 |
| 6,863,228 | B2 | 3/2005 | Mao et al. | |
| 6,871,488 | B2 | 3/2005 | Oskooei et al. | |
| 7,454,914 | B2 | 11/2008 | Prociw | |
| 7,509,811 | B2 | 3/2009 | Chen et al. | |
| 7,520,134 | B2 | 4/2009 | Durbin et al. | |
| 7,533,531 | B2 | 5/2009 | Prociw et al. | |
| 7,707,833 | B1 | 5/2010 | Bland et al. | |
| 7,926,178 | B2 | 4/2011 | Thomson et al. | |
| 7,926,282 | B2 | 4/2011 | Chew et al. | |
| 2006/0242965 | A1 | 11/2006 | Shi et al. | |
| 2008/0236165 | A1 * | 10/2008 | Baudoin et al. | 60/746 |
| 2009/0255258 | A1 | 10/2009 | Bretz et al. | |
| 2010/0139238 | A1 | 6/2010 | Hall et al. | |
| 2011/0031333 | A1 | 2/2011 | Short | |

FOREIGN PATENT DOCUMENTS

| | | | |
|---|---|---|---|
| EP | 1426689 | A1 | 6/2004 |
| EP | 1605208 | A1 | 12/2005 |

OTHER PUBLICATIONS

C. Lee et al., "High Pressure Low Nox Emissions Research: Recent Progress at NASA Glenn Research Center," ISABE-2007-1270 (2007).

K. M. Tacina et al. "NASA Glenn High Pressure Low NOX Emissions Research," NASA/TM-2008-214974 (2008).

The Extended European Search Report for Application No. 11250766.0, dated Aug. 13, 2012.

DLN 2.6+ Combustion System for Frame 9FA, GE Energy Fact Sheet, GEA-14358 (Nov. 2005), 2005 General Electric Company.

Brun, K., Kurz, R., IGCC Combusion Challenges, Turbomachinery international, May/Jun. 2010 p. 52.

Paisley, M.A., Welch, M.J., Biomass Gasification Combined Cycle Opportunities Using the Future Energy Silvagas® Gasifier Coulpled to Alstom's Industrial Gas Turbines, Proceedings of ASME Turbo Expo 2003, ASME Turbo Expo Land, Sea and Air 2003, Georgia World Congress Center, Jun. 16-19, 2003, GT2003-38294.

Johnson, C., Pepperman, B., Keonig, M., Khalil, A., Gulati, A., Moradian, A., Hall, G., Ultra Low Nox Combustion Technology, Power-Gen International, Dec. 2008, Siemens Power Generation, Inc. 2008.

Energy Solutions for Combined Heat and Power, THM 1304-11 Gas Turbines to Total Solutions, MAN Turbomachinery Inc., Sep. 2003.

Partial search report dated Apr. 19, 2012 in connection with European application 11250766.0.

* cited by examiner

A
122
100
124
118
120
116
120
112
112
108
113
114
113
102
A

MULTIPOINT INJECTORS WITH AUXILIARY STAGE

CROSS-REFERENCE TO RELATED APPLICATIONS

This application is a continuation-in-part of U.S. patent application Ser. No. 12/954,008 filed Nov. 24, 2010 and published as U.S. Patent Application Publication No. 2012/0125008, which is incorporated by reference herein in its entirety.

BACKGROUND OF THE INVENTION

1. Field of the Invention

The present invention relates to gas turbine engines, and more particularly to gas turbine engines utilizing low calorific value fuels.

2. Description of Related Art

Gasification of coal, biomass, and other fuels produces fuel gas that can be used for power production. Fuel gas derived from gasification or other such processes is commonly referred to as low calorific value (LCV) fuel because it typically has significantly lower heating values compared to more traditional fuels. Whereas natural gas typically has a heating value of about 1,000 BTU/Ft$^3$, LCV gas can have a heating value on the order of only about 130 BTU/Ft$^3$ and less. LCV gas can be used with or as a replacement for more traditional fuels in applications including internal combustion engines, furnaces, boilers, and the like. In addition to environmental concerns, fluctuating fuel costs and availability drive a growing interest in use of LCV fuels where more traditional fuels, such as natural gas, are typically used.

While there is growing interest in LCV fuels, the low heating value of LCV fuel creates obstacles to its more widespread use. Thus there is an ongoing need for improved LCV fuel combustion systems. For example, the use of LCV fuel in an existing, conventional gas turbine engine requires special considerations regarding the fuel injection system. Flammability of LCV fuel gas can be unknown due to variables in the gasification process, so there is typically an unpredictable flameout limit when lowering fuel flow to operate at reduced power. Due to the relatively low heating value, LCV fuel can require 10 to 12 times the volumetric flow rate of natural gas for which the original engine was designed, which can give rise to capacity complications for traditional combustion systems. Typical gasification systems produce LCV fuel through high-temperature processes, and LCV fuel is often supplied directly from the gasification system. The LCV fuel temperature can be significantly hotter than in conventional fuel systems, which can give rise to further thermal management concerns. Additionally, due to the low calorific value, the fuel can present difficulties in terms of start up and flame stabilization.

Some solutions to these challenges have been proposed, such as using large numbers of small injectors, and allowing for mixing traditional fuel in with LCV fuel. However, the high flow rates needed to provide an adequate supply of LCV fuel lead to significant pressure drop, which is exacerbated by using large numbers of small injectors. High pressure drop can severely impact overall thermal efficiency for gas turbine engines, for example. Start up and flame stabilization challenges persist in typical LCV fuel injection systems.

Such conventional methods and systems have generally been considered satisfactory for their intended purpose. However, there is still a need in the art for combustion systems and methods that allow for improved start up, flame stability, and fuel staging. There also remains a need in the art for such systems and methods that are easy to make and use. The present invention provides a solution for these problems.

SUMMARY OF THE INVENTION

The subject invention is directed to a new and useful a multipoint combustion system for a gas turbine engine. The system includes a housing defining a pressure vessel. A master injector is mounted to the housing for injecting fuel in an injection plume along a central axis defined through the pressure vessel. A plurality of slave injectors are each disposed outward of and substantially parallel to the master injector for injecting fuel and air in an ignition plume radially outward of fuel injected through the master injector. The master injector and slave injectors are configured and adapted so the injection plume of the master injector intersects with the ignition plumes of the slave injectors. Each of the slave injectors is an injector for a low-calorific value fuel as described below. A primary manifold is included within the pressure vessel for distributing fuel to the slave injectors. An auxiliary manifold is in fluid communication with the auxiliary nozzles of the slave injectors for issuing an auxiliary flow of fuel from the auxiliary nozzles that is separate from the fuel flow of the primary manifold.

In certain embodiments, the pressure vessel includes a pressure dome with a central aperture and a central inlet fitting mounted to the central aperture of the pressure dome, wherein the auxiliary manifold is external to the pressure dome. The primary and auxiliary manifolds can advantageously be thermally isolated from one another. The auxiliary nozzles of the slave injectors can be mounted to the pressure vessel with floating seals to accommodate thermal expansion differentials between the pressure vessel and the auxiliary manifold. The auxiliary manifold can advantageously be flexible for ease of installation and to accommodate thermal expansion differentials for example. The auxiliary manifold can be configured and adapted to issue at least one of natural gas and liquid fuel to the auxiliary nozzles of the slave injectors. The auxiliary manifold can be operatively connected to an external valve to permit purging of the auxiliary manifold and auxiliary nozzles with engine air for complete shutdown of the auxiliary manifold and nozzles.

The invention also provides an injector for a low-calorific value fuel combustion system. The injector includes a nozzle body defining a fuel circuit for injecting low-calorific value fuel. An auxiliary nozzle is mounted to the nozzle body and defines a fuel circuit for injecting at least one of natural gas and liquid fuel.

In accordance with certain embodiments, the auxiliary nozzle is mounted to the nozzle body with a floating seal to accommodate a differential in thermal expansion between the auxiliary nozzle and the nozzle body. The fuel circuit of the nozzle body can be annular and the nozzle body can define an outer air circuit outboard of the fuel circuit of the nozzle body. The auxiliary nozzle can advantageously include a fuel outlet configured and adapted to issue a spray of fuel that diverges away from a longitudinal axis defined by the auxiliary nozzle.

In certain embodiments the nozzle body includes an inner wall and an outer wall outboard of and spaced apart from the inner wall, wherein the fuel circuit of the nozzle body passes through the inner and outer walls. The outer wall can define at least one aperture configured for passage of fuel from the primary manifold into the nozzle body for selective injection of at least natural gas and LCV fuel gas in a proportional mix. The auxiliary nozzle can be inboard of and spaced apart from the inner wall of the nozzle body. It is contemplated that the nozzle body and auxiliary nozzle can define a common longitudinal axis, wherein the auxiliary nozzle and nozzle body each include a respective fuel outlet, and wherein the fuel outlet of the auxiliary nozzle is upstream relative to the outlet of the nozzle body along the longitudinal axis.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
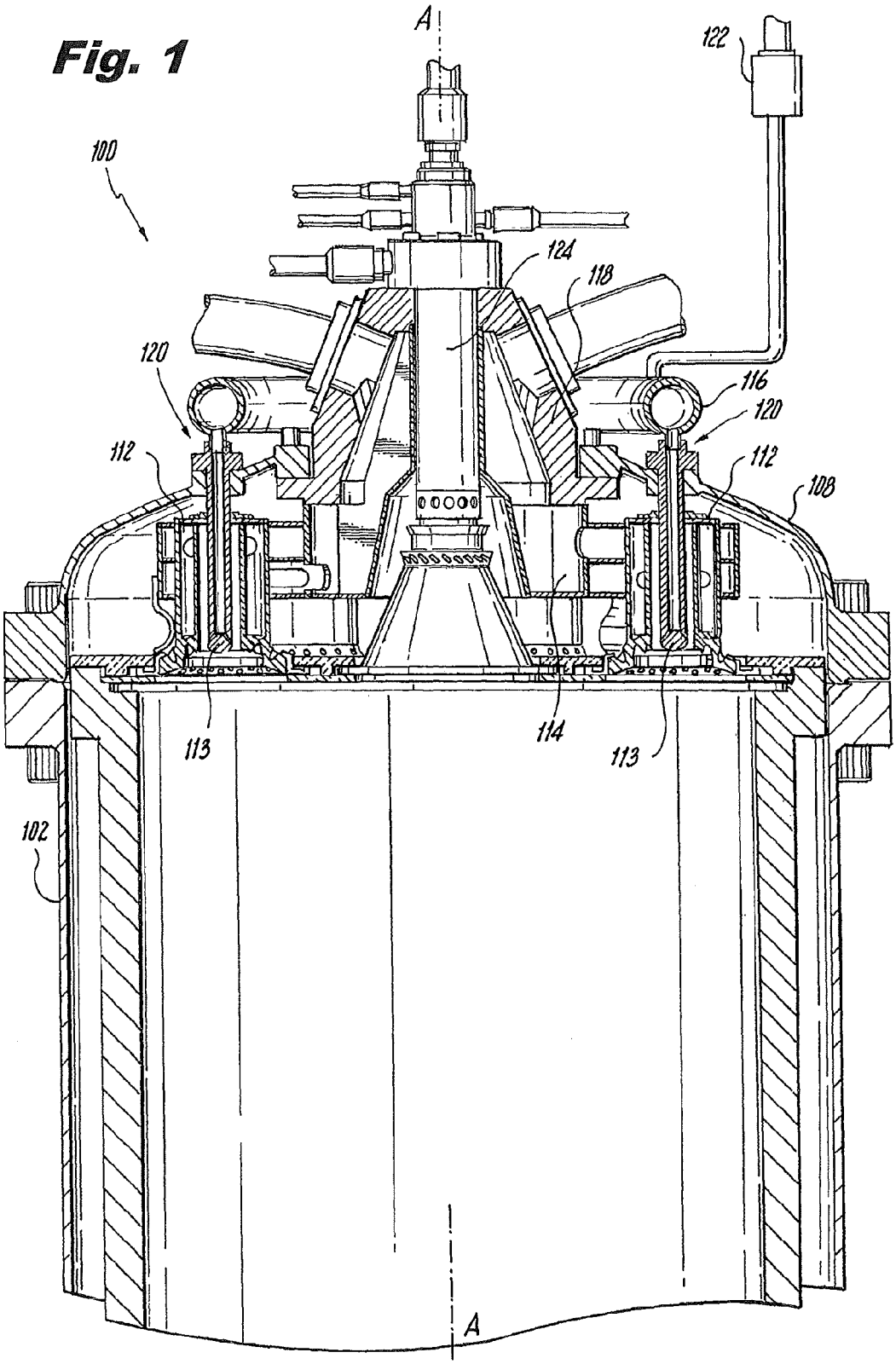
FIG. 1 is a cross-sectional side elevation view of an exemplary embodiment of a LCV fuel combustor constructed in accordance with the present invention, showing the master and slave nozzles.

Reference will now be made to the drawings wherein like reference numerals identify similar structural features or aspects of the subject invention. For purposes of explanation and illustration, and not limitation, a partial view of an exemplary embodiment of a multipoint combustion system in accordance with the invention is shown in FIG. 1 and is designated generally by reference character 100. Other embodiments of combustion systems in accordance with the invention, or aspects thereof, are provided in FIG. 2, as will be described. The systems and methods of the invention can be used to supply low temperature fuel to LCV combustors, for example liquid fuel for startup.

Referring now to FIG. 1, a multipoint combustion system 100 for a gas turbine engine includes a housing 102 defining a pressure vessel. A master injector 124 is mounted to the housing 102 for injecting fuel in an injection plume along a central axis A defined through the pressure vessel. A plurality of slave injectors 112 are each disposed outward of and substantially parallel to master injector 124 for injecting fuel and air in an ignition plume radially outward of fuel injected through master injector 124. Master injector 124 and slave injectors 112 are configured and adapted so the injection plume of the master injector intersects with the ignition plumes of slave injectors 112. Each of the slave injectors 112 is an injector for a low-calorific value fuel as described below. A primary manifold 114 is included within the pressure vessel for distributing fuel, e.g., low-calorific value gaseous fuel, to slave injectors 112. An auxiliary manifold 116 is in fluid communication with the auxiliary nozzles 113 of slave injectors 112 for issuing an auxiliary flow of fuel, e.g., liquid fuel used for starting the ignition sequence of system 100, from auxiliary nozzles 113. Auxiliary manifold 116 provides for a separate fuel flow from the fuel flow of primary manifold 114.

The pressure vessel of housing 102 includes a pressure dome 108 with a central aperture and a central inlet fitting 118 mounted to the central aperture of the pressure dome 108. Auxiliary manifold 116 is external to pressure dome 108. The primary and auxiliary manifolds 114 and 116 are advantageously thermally isolated from one another. The auxiliary nozzle 113 of each respective slave injector 112 is mounted to the pressure vessel, namely at pressure dome 108, with floating seals 120 to accommodate thermal expansion differentials between the pressure vessel and auxiliary manifold 116.

Auxiliary manifold 116 is advantageously flexible, e.g., for ease of installation and to accommodate thermal expansion differentials. For example, auxiliary manifold 116 can be a high temperature hose or other suitable conduit with flexibility. Auxiliary manifold 116 is configured to issue natural gas and/or liquid fuel to auxiliary nozzles 113 of slave injectors 112, or any other suitable type of liquid or gaseous fuel. Auxiliary manifold 116 is operatively connected to an external valve 122, which can be opened to permit purging of auxiliary manifold 116 and auxiliary nozzles 113, for example with engine air, for complete shutdown of auxiliary manifold 116 and auxiliary nozzles 113. So if, for example, a liquid hydrocarbon fuel is used in auxiliary manifold 116 and nozzles 113 for startup of system 100, after startup the interior of auxiliary manifold 116 and auxiliary nozzles 113 can be purged to prevent stagnant liquid fuel from coking therein when system 100 is operating at full operational temperatures.

Figure 2:
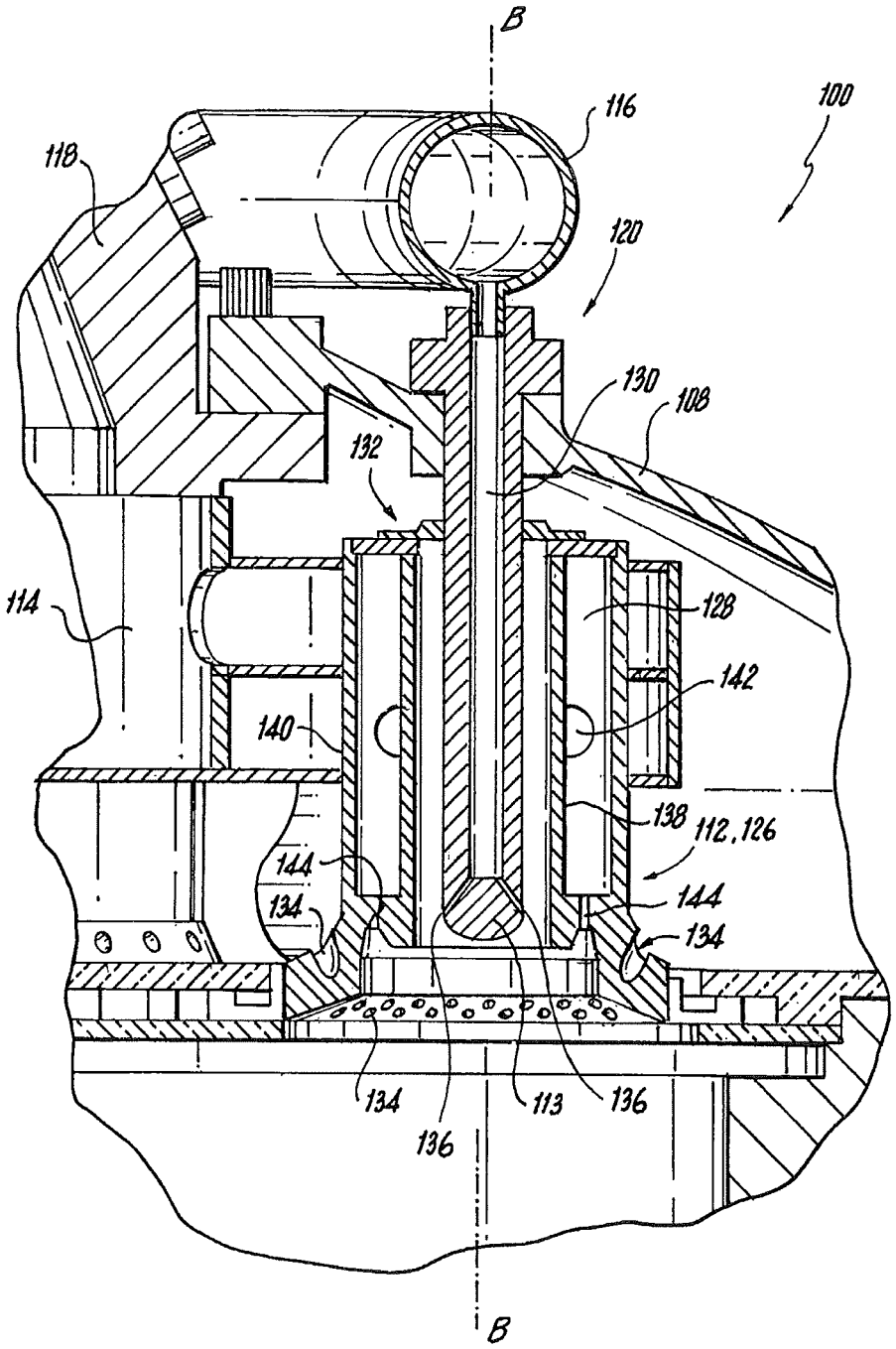
FIG. 2 is a cross-sectional side elevation view of a portion of the combustor of FIG. 1, showing one of the slave nozzles with the auxiliary nozzle mounted in the nozzle body.

Referring now to FIG. 2, one of the slave injectors 112 is shown in more detail. Slave injectors 112 are configured for use in low-calorific value fuel combustion systems as described above. Each slave injector 112 includes a nozzle body 126 defining a fuel circuit 128 for injecting low-calorific value fuel. An auxiliary nozzle 113 is mounted to nozzle body 126 and defines a fuel circuit 130 for injecting an auxiliary fuel, for example natural gas or liquid fuel, such as for use in engine startup. Each auxiliary nozzle 113 is mounted to the respective nozzle body 126 with a floating seal 132, which can be for example a grommet, to accommodate a differential in thermal expansion between auxiliary nozzle 113 and nozzle body 126, e.g., when cold liquid fuel is flowing through auxiliary circuit 130, but the overall system is heating up during startup. The auxiliary stage is more suitable than the primary stage for bringing an engine up to power due to the small passage size and relatively high back pressure of the auxiliary stage. The auxiliary stage can be turned down to pilot the LCV fuel operation, or could be flushed and shut down for long term LCV operation using valve 122.

Fuel circuit 128 of nozzle body 126 is annular and nozzle body 126 defines an outer air circuit 134 outboard of fuel circuit 128. Each auxiliary nozzle 113 advantageously includes a fuel outlet 136 configured and adapted to issue a spray of fuel that diverges away from a longitudinal axis defined by the auxiliary nozzle 113.

Nozzle body 126 includes an inner wall 138 and an outer wall 140 outboard of and spaced apart from inner wall 138. Fuel circuit 128 of nozzle body 126 passes through, e.g., between, inner and outer walls 138 and 140. Outer wall 140 defines at least one aperture 142 configured for passage of fuel from primary manifold 114 into nozzle body 126 for selective injection of natural gas and LCV fuel gas in a proportional mix, for example. Auxiliary nozzle 113 is inboard of and spaced apart from inner wall 138 of nozzle body 126.

Nozzle body 126 and auxiliary nozzle 113 define a common longitudinal axis B. Auxiliary nozzle 113 defines outlet 136 as described above, and nozzle body 126 includes fuel outlet 144. Fuel outlet 136 of auxiliary nozzle 113 is upstream relative to outlet 144 of nozzle body 126 along longitudinal axis B.

While described above in the exemplary context of gas turbine engines, those skilled in the art will readily appreciate that the systems and methods described above can be used with any suitable LCV fuel application. Moreover, the systems and methods described above can be used in any suitable non-LCV application without departing from the spirit and scope of the invention.

The methods and systems of the present invention, as described above and shown in the drawings, provide for low calorific value fuel combustion systems with superior properties including improved engine start up and thermal management. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. An injector for a low-calorific value fuel combustion system comprising:

a nozzle body defining a fuel circuit for injecting low-calorific value fuel; and an auxiliary nozzle mounted to the nozzle body and defining a fuel circuit for injecting at least one of natural gas and liquid fuel;

an inner set of injection ports defined at an outlet of the nozzle body, wherein the inner set is configured to inject a flow of fuel;

an intermediate set of injection ports defined radially outward from the inner set at an outlet of an air circuit, wherein the intermediate set is aligned to inject a converging, swirling flow of air, which intersects the flow of fuel from the innermost set; and an outer set of injection ports defined radially outward from the intermediate set at the outlet of the air circuit, wherein the outermost set is aligned to inject a converging, non-swirling flow of air, which converges into the flows of gas and air from innermost and intermediate sets, wherein the nozzle body includes an inner wall and an outer wall outboard of and spaced apart from the inner wall, wherein the fuel circuit of the nozzle body passes through the inner and outer walls, and wherein the auxiliary nozzle is inboard of and spaced apart from the inner wall of the nozzle body.

2. An injector as recited in claim 1, wherein the auxiliary nozzle is mounted to the nozzle body with a floating seal to accommodate a differential in thermal expansion between the auxiliary nozzle and the nozzle body.

3. An injector as recited in claim 1, wherein the fuel circuit of the nozzle body is annular and wherein the nozzle body defines an outer air circuit outboard of the fuel circuit of the nozzle body.

4. An injector as recited in claim 1, wherein the outer wall defines at least one aperture configured for passage of fuel from a fuel manifold into the nozzle body for selective injection of at least natural gas and LCV fuel gas in a proportional mix.

5. An injector as recited in claim 1, wherein the nozzle body and auxiliary nozzle define a common longitudinal axis, and wherein the auxiliary nozzle and nozzle body each include a respective fuel outlet, and wherein the fuel outlet of the auxiliary nozzle is upstream relative to the outlet of the nozzle body along the longitudinal axis.

6. An injector as recited in claim 1, wherein the auxiliary nozzle includes a fuel outlet configured and adapted to issue a spray of fuel that diverges away from a longitudinal axis defined by the auxiliary nozzle.

7. A multipoint combustion system for a gas turbine engine, comprising:

a housing defining a pressure vessel;

a master injector mounted to the housing for injecting fuel in an injection plume along a central axis defined through the pressure vessel;

a plurality of slave injectors each disposed outward of and substantially parallel to the master injector for injecting fuel and air in an ignition plume radially outward of fuel injected through the master injector, wherein the master injector and slave injectors are configured and adapted so the injection plume of the master injector intersects with the ignition plumes of the slave injectors, wherein each of the slave injectors is an injector as recited in claim 1;

a primary manifold within the pressure vessel for distributing fuel to the slave injectors; and an auxiliary manifold in fluid communication with the auxiliary nozzles of the slave injectors for issuing an auxiliary flow of fuel from the auxiliary nozzles that is separate from fuel I flow of the primary manifold, wherein the pressure vessel includes a pressure dome, wherein the auxiliary manifold and primary manifold are on opposing sides of the pressure dome, and wherein the primary and auxiliary manifolds are thermally isolated from one another.

8. A multipoint combustion system as recited in claim 7, wherein the pressure dome includes a central aperture and a central inlet fitting mounted to the central aperture of the pressure dome.

9. A multipoint combustion system as recited in claim 7, wherein the auxiliary nozzles of the slave injectors are mounted to the pressure vessel in a floating sealing engagement to accommodate thermal expansion differentials between the pressure vessel and the auxiliary manifold.

10. A multipoint combustion system as recited in claim 7, wherein the auxiliary manifold is flexible.

11. A multipoint combustion system as recited in claim 7, wherein the auxiliary manifold is configured and adapted to issue at least one of natural gas and liquid fuel to the auxiliary nozzles of the slave injectors.

12. A multipoint combustion system as recited in claim 7, wherein the auxiliary manifold is operatively connected to an external valve to permit purging of the auxiliary manifold and auxiliary nozzles with engine air for complete shutdown of the auxiliary manifold and nozzles.

13. A multipoint combustion system as recited in claim 7, further comprising an outlet bulkhead mounted to outlets of each of the master and slave injectors, the outlet bulkhead having an outlet opening sealed around an outlet of each injector.

14. A combustor system as recited in claim 13, wherein a floating collar is movably mounted to each outlet opening to seal between the outlet of each respective injector and the outlet bulkhead to accommodate relative thermal expansion and contraction of the injectors and outlet bulkhead.

* * * * *